United States Patent [19]

Saulas

[11] Patent Number: 4,989,778

[45] Date of Patent: Feb. 5, 1991

[54] CARTON WITH SLOT TYPE CARRYING HANDLE

[75] Inventor: Alain Saulas, Chateauroux, France

[73] Assignee: The Mead Corporation, Dayton, Ohio

[21] Appl. No.: 502,097

[22] Filed: Mar. 30, 1990

[30] Foreign Application Priority Data

Apr. 1, 1989 [GB] United Kingdom ..... 8907407

[51] Int. Cl.[5] ..... B65D 5/46

[52] U.S. Cl. ..... 229/117.13; 206/141

[58] Field of Search ..... 229/40, 117.13; 206/427, 141

[56] References Cited

U.S. PATENT DOCUMENTS

| | | | |
|---|---|---|---|
| 2,598,051 | 5/1952 | Guyer et al. | 229/117.13 |
| 3,078,032 | 2/1963 | Robinson et al. | 229/117.13 |
| 4,405,078 | 9/1983 | Dutcher et al. | 229/117.13 |
| 4,785,991 | 11/1988 | Schuster | 229/117.13 |

FOREIGN PATENT DOCUMENTS

| | | |
|---|---|---|
| WO87/02648 | 5/1987 | PCT Int'l Appl. . |
| 1103372 | 2/1968 | United Kingdom . |
| 1602857 | 11/1981 | United Kingdom . |

*Primary Examiner*—Gary E. Elkins

*Attorney, Agent, or Firm*—Erwin Doerr

[57] ABSTRACT

A carrying handle (H) in a multi-unit carton for accommodating a number of primary containers comprising interconnected top (14), bottom (18) and side walls (12, 16). The carrying handle comprising an ovate slot (46) in the carton top wall (14), and a slit (48, 48*a;* 50, 50*a*) or other line of weakness extending from opposed ends of the slot and extending into respective ones of the two carton side walls. A handle panel (Ha, Hb) provided by part of the top wall is hinged along a fold line (64, 66) extending across the top wall the handle panel having a free edge defined in part by the slot and in part by the slits. Thus, either handle panel can be grasped and hinged upwardly away from the tops of the packaged containers so that the carton can more easily be held.

6 Claims, 2 Drawing Sheets

CARTON WITH SLOT TYPE CARRYING HANDLE

This invention relates to a multi-unit carton which is particularly suitable for packaging several parallelapiped containers sometimes referred to as 'brik' cartons. Such 'briks' are normally formed from a composite paperboard or a like material having an inner fluid resistant lining and more usually containing a foodstuff or beverage such as fruit juice, milk or soup.

These briks have walls which are relatively 'soft' i.e. exhibit some 'give' when pressure is applied to them but which recover to their previous disposition when the applied pressure is relieved.

There is a demand for the sale of such containers in multiple units of, say, six containers and one aspect of the present invention is concerned with a retaining carton, in some cases comprising a wrapper which holds together in a group a number of such brik containers to provide a 'carry home' carton. The carton wrapper is designed to provide a carrying handle which may also be applicable to other types of multi-unit carton and which of itself provides another aspect of the present invention.

U.S. Pat. No. 4,558,816 owned by the assignee of the present application discloses a can carton having a slot type handle construction comprising an elongate opening in the top wall of the carton. Handle panels which have a free edge defined, at least in part, by the opening and which hinge relative to the top wall are not provided. In this prior construction, the arrangement of cans within the carton allows a users hand to grasp the carton through the top wall opening relatively easily. However, where the packaged containers are flat topped 'briks' there is little space available between the carton top wall and the tops of the briks to grasp the carton. The present invention seeks to overcome this problem, and to this end, one aspect of the present invention provides, in a multi-unit carton for accommodating a number of primary containers comprising interconnected top, bottom and side walls, a carrying handle comprising an opening or means defining an opening in one carton wall, a line of weakness extending from opposed locations at the periphery of said opening means and extending into respective ones of the two carton walls interconnected with said one carton wall, wherein a handle panel provided by a part of said top wall is hinged along a fold line extending across said top wall said handle panel having a free edge defined in part by said opening and in part by said lines of weakness.

According to a feature of this aspect of the invention, opposite end parts of said handle panel may be adapted to flex inwardly of the carton relative to an intermediate part of said handle panel when the carton is lifted by that handle panel.

Preferably, the opening is generally ovate and extends centrally across the said one carton wall.

Preferably, each of said end parts is provided in part by said one carton wall and in part by the adjacent carton wall interconnected therewith.

The end parts of the handle panel may be delineated from said intermediate part of the handle panel by a pair of spaced fold lines formed in said one carton wall each of such handle panel fold lines extending between a location adjacent one end of said opening and the fold line between said one carton wall and the adjacent interconnected carton wall.

Preferably, a fold line is formed in each of said two carton walls and extends from the free end of said slit means to meet the fold line in said one carton wall by which the handle panel hinges.

Cut lines may be formed at the junction between said fold lines in each of the two carton walls and the fold line in said one carton wall by which the handle panel hinges to facilitate hinging of said handle panel.

According to yet another feature of this aspect of the invention said lines of weakness may be positioned in said two carton walls substantially centrally of the wall of a primary container adjacent thereto.

According to a still further feature of this aspect of the invention, each of the said two carton walls may be connected together at each end of said carton by end closure panels which at least partially close the opposite ends of the carton.

According to a still further feature of the invention a pair of like handle panels may be provided, each according to any of the eight immediately preceding paragraphs.

Another aspect of the invention provides a carton blank comprising a plurality of panels, for providing the side walls, top and bottom walls of a carton, hinged one to the next in which the panel for providing the top wall is disposed intermediate a pair of panels for providing side walls of the carton wherein said top wall panel is formed with an opening or means defining an opening from opposed peripheral locations of which lines of weakness extend into respective ones of the side wall panels and wherein a handle panel provided by a part of said top wall panel is hinged along a fold line extending across said top wall, said handle panel having a free edge defined in part by said opening and in part by said lines of weakness.

According to a feature of this aspect of the invention a pair of like handle panels may be provided, each according to that defined in the immediately preceding paragraph.

An embodiment of the invention will now be described, by way of example, with reference to the accompanying drawings, in which.

Figure 2:
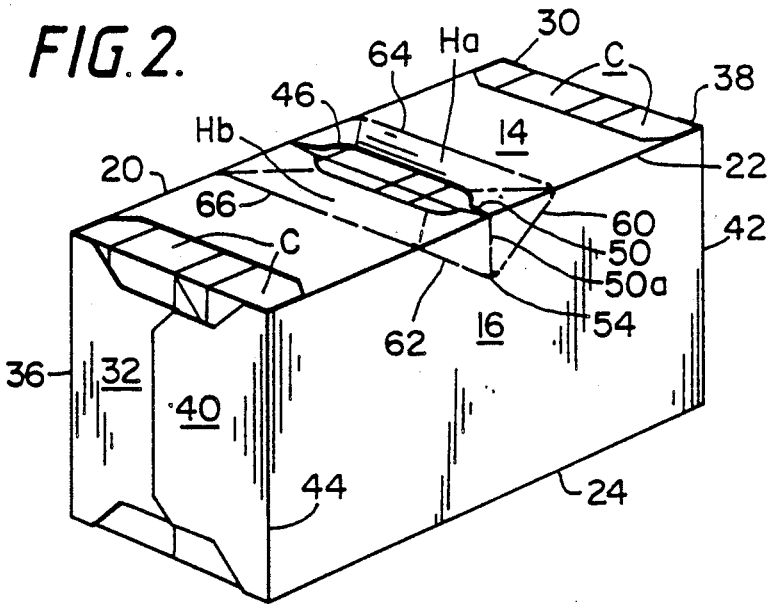
FIG. 2 is a perspective view of a carton according to the invention accommodating a group of parallelapiped 'brik' containers.

Referring to the drawings, an elongate blank 10 of paperboard or like foldable sheet material comprises a first side wall panel 12, a top wall panel 14, a second side wall panel 16 and a base panel 18 hinged one to the next along transverse fold lines 20, 22 and 24 respectively. The blank is thereby adapted to be manipulated to form a tubular structure around a group of parallelapiped containers 'c' or 'briks' and is maintained in its tubular form by fastening a securing strip 26, hinged to bottom wall 18 along a transverse fold line 28, to the free transverse edge of side wall panel 12.

At each of its shorter ends side panel 12 carries an end closure panel 30 and 32 hinged to side panel 12 along longitudinal fold lines 34 and 36 respectively.

Similarly, end closure panels 38 and 40 are hinged to the shorter ends of side wall panel 16 along longitudinal fold lines 42 and 44 respectively.

Figure 1:
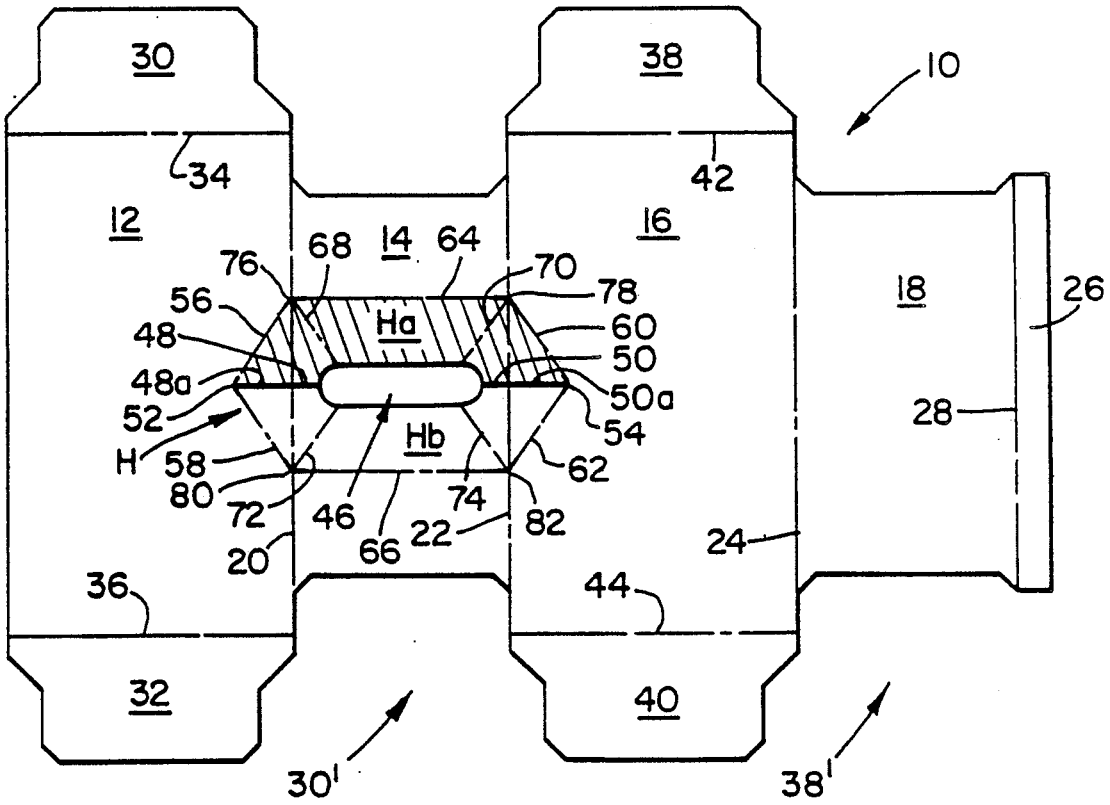
FIG.1 is a plan view of a carton blank having a carrying handle according to one aspect of the invention.
Figure 3:
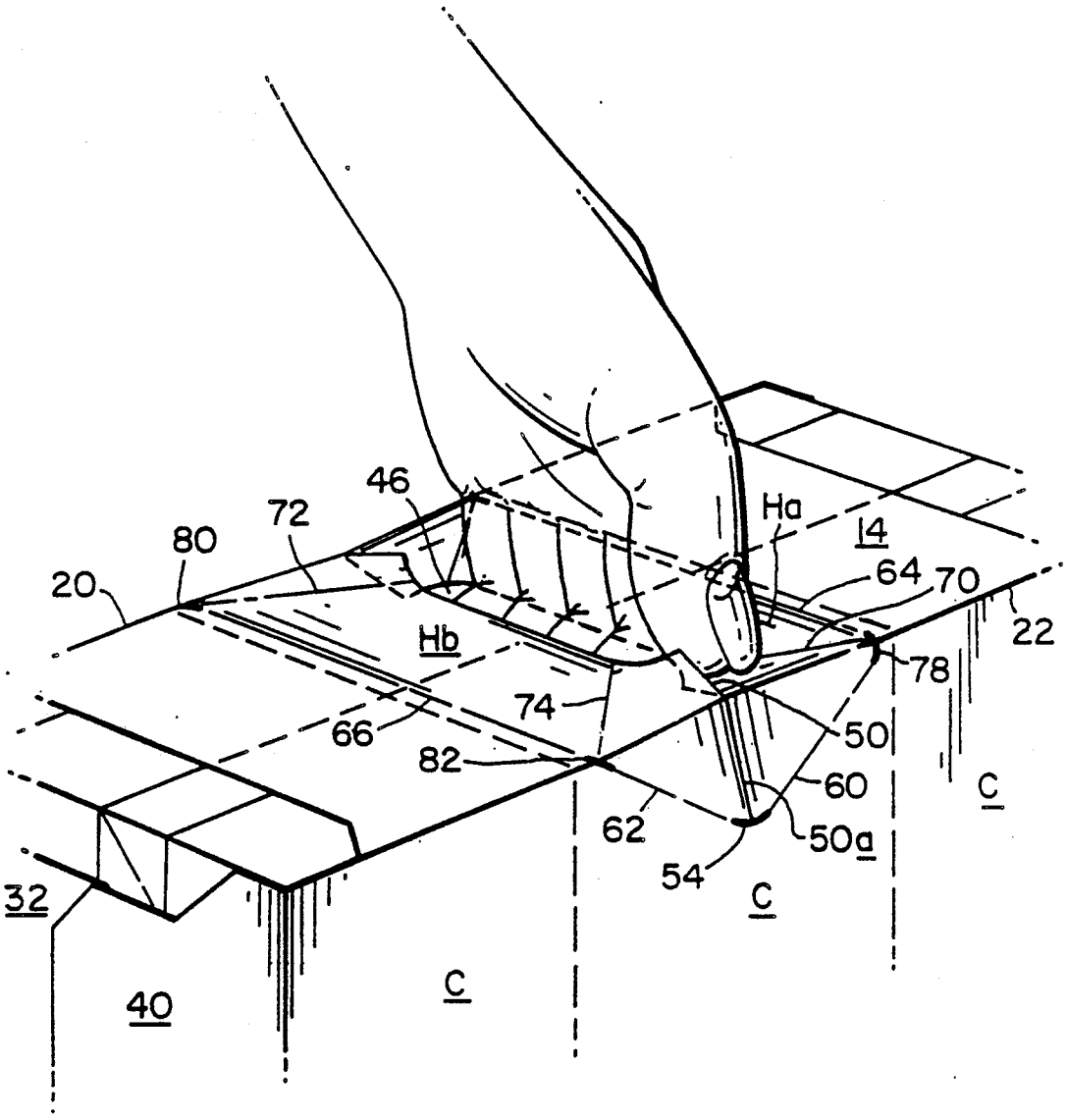
FIG. 3 is a more detailed view of the upper part of the carton incorporating a carrying handle according to the invention.

The end closure panels and top and bottom panels are sized and configured so that a pair of like blanks can be arranged side by side on a web of paperboard stock in 'nested' configuration whereby, for example, the end closure panels 30 and 38 of one blank are disposed in the spaces 30', 38' alongside end closure panels 32 and 40, respectively of the next adjacent blank (FIG. 1).

Top wall panel 14 is formed with a carrying handle construction H. Handle construction H includes a generally ovate opening 46 extending centrally across top wall panel 14 but stopping short of the edges of the top wall panel defined by fold lines 20 and 22 respectively. The ovate opening may initially be closed by a pair of frangibly connected hinged handle flaps similar to the handle construction disclosed in U.S. Pat. No. 4,558,816.

In other respects also the handle construction of this invention is similar to that disclosed in U.S. Pat. No. 4,558,816. To this end, slits 48 and 50 extend from each of the arcuate ends of the opening 46 to the adjacent side edge fold lines 20, 22, respectively, of the top wall. Slits 48 and 50 are aligned with a notional longitudinal center line of the opening 46. Thus, in a construction where handle flaps as mentioned above are provided, a continuous slit incorporating slits 48 and 50 would extend completely across the top wall panel. Normally where the blank is intended for use with parallelapiped containers, handle flaps (which serve to enhance both mechanical strength and to afford a cushion to protect the hand of a user) would not be utilised because there is little available space between the flat tops of the containers and the top wall panel of the blank for flaps to be folded. However, if the present handle construction were to be adopted for the can carton of U.S. Pat. No. 4,558,816 such flaps may be provided since the gap between the cylindrical walls of abutting cans gives sufficient space to allow for the inward folding of such handle flaps.

The slits 48 and 50 extend into the adjacent side wall panels to provide slit extensions **48*a* and 50*a*, respectively. In the embodiment shown, the slit extensions are aligned with slits 48 and 50 when the blank is in flat form as can be seen by FIG. 1** but slit extensions which are not so aligned also may suffice. It is also envisaged that the slits may comprise perforate lines of weakness which are breakable when the handle is manipulated thereby to form the slits and/or slit extensions in use.

Each of the slit extensions terminate in a short arcuate cut line 52 and 54, respectively, extending generally across the direction of the line of cut of the respective slit extensions thereby to resist tearing of the side wall panels downwardly beyond the ends of the slit extensions.

A pair of fold lines 56, 58 and 60, 62 extend (upwardly, as seen in the completed package) from, and at an acute angle to, respective ones of the slit extensions **48*a*, 50*a* and meet the fold lines 20, 22 between the associated side wall panel 12, 16 respectively and the top wall panel 14**.

A fold line 64 joins together the (upper) ends of fold lines 56 and 60 across top wall panel 14 and likewise a parallel fold line 66 joins together the (upper) ends of fold lines 58 and 62 across top wall panel 14.

Thus a first handle panel Ha is defined by part of the peripheral edge of the opening 46, slits 48, 50 and slit extensions **48*a*, 50*a*; oblique side wall fold lines 56 and 60 and the interconnecting top wall fold line 64, and, similarly, a second handle panel Hb is defined by an opposed part of the peripheral edge of the opening 46; slits 48, 50 and slit extensions 48*a*, 50*a*; oblique side wall fold lines 58 and 62 and the interconnecting top wall fold line 66. Handle panel Ha is shown shaded in FIG. 1**.

In order to allow the handle panel Ha to exhibit some 'give' to allow a user to grasp the panel so that it can be lifted away from the flat tops of the briks sufficiently to allow the user to gain proper purchase to carry the carton fold lines 68 and 70 extend across panel Ha.

Fold line 68 extends from the junction between fold lines 56 and 64 at fold line 20 to meet the opening 46 adjacent one of its arcuate ends. Similarly, fold line 70 extends from the junction between fold lines 60 and 64 at fold line 22 to meet the opening 46 adjacent the other of its arcuate ends.

Of course handle panel Hb may also be utilised to carry the carton instead of handle panel Ha and therefore is of like construction. Thus, fold lines 72 and 74 extend across panel Hb. Fold line 72 extends from the junction between fold lines 58 and 66 at fold line 20 to meet the opening 46 adjacent the said one arcuate end and, similarly, fold line 74 extends from the junction between fold lines 62 and 66 at fold line 22 to meet the opening 46 adjacent the said other of its arcuate ends. At each of the junctions referred to above in relation to fold lines 68, 70, 72 and 74 the wrapper is formed with short arcuate cut lines 76, 78, 80 and 82, respectively, each similar to cut lines 52 and 54 to improve the hinging action of handle panels Ha and Hb relative to respective ones of fold lines 64 and 66 when those handle panels are manipulated.

Lifting of the carton by either one of the handle panels is therefore contemplated and FIG. 2 illustrates the package being lifted by handle panel Hb. As a users hand is slipped under handle panel Hb to lift the carton, the two triangular structures of handle panel Ha defined by, respectively, slit extension **50*a* and fold lines 22, 60, 70 and by slit extension 48*a* and fold lines 22, 56, 68 are caused to bend inwardly against the side wall of an adjacent brik carton. This inward bending operation results in a distribution of the dead weight of the carton over a wide area of the carton side wall, as is known, and to some extent transfers some of that load to the adjacent brik containers whose side walls distort or 'give' somewhat as a consequence. Indeed this 'give' by the relatively soft container side walls is exploited in that the handle panels are positioned across the central pair of briks in the carton so that the inward bending of the triangular structures occurs generally at the midpoint in the adjacent container wall where it is most flexible. As a result the distance by which the handle Hb can be hinged away from the tops of the underlying briks is increased. This hinging to facilitate purchase on the handle panel is facilitated by the cut lines 76 and 78** at the corners of the handle panel Hb.

In applications where the packaged containers, e.g. cans do not exhibit any flexibility it is thought that the handle construction of this invention also has applicability in that some 'give' in the side walls of the carton is usually present sufficient to achieve the requisite bending action to allow the handle panel to be lifted upwardly out of its rest position flush with the top wall panel of the package.

I claim:

1. A carton blank comprising:

a plurality of interconnected panels for providing top, bottom and side walls of a carton;

an opening in said top panel having a peripheral edge;

slit means extending from opposed locations on said peripheral edge across said top panel and into the adjacent one of said side wall panels;

a handle panel defined in said top panel by a handle fold line extending across said top panel, said handle panel defining a free edge along said slit means and the corresponding portions of the peripheral edge between said slit means, and a second handle panel defined by a second handle fold line extending across said top panel, said second handle panel having a free edge defined by said peripheral edge of said opening and by said slit means.

2. In a carton accommodating a plurality of primary containers and including interconnected top, bottom and side walls, a carrying handle comprising:

an opening extending in said top wall and having a peripheral edge;

slit means extending from opposed locations on said peripheral edge into respective ones of said side walls;

a handle panel defined in said top wall by a handle fold line extending across said top wall, said handle panel defining a free edge along said slit means and the peripheral edge between said slit means, said handle panel further including end portions defined in part by said top wall and in part by the adjacent one of said side walls characterized in that said end portions of said handle panel are delineated from an intermediate part of said handle panel by a pair of spaced fold lines formed in said top wall, each of said spaced fold lines extending between said peripheral edge of said opening and said handle fold line at the connection between said top wall and the adjacent one of said side walls.

3. A carrying handle according to claim 2 wherein an end fold line is formed in each of said side walls and extends from the free end of said slit means to meet said handle fold line in said top carton wall.

4. A carrying handle according to claim 3 wherein transverse cut lines are formed at the junction between said end fold lines and said slit means, and between said handle fold line and said end fold lines to facilitate hinging of said handle panel.

5. A carrying handle according to claim 2 wherein said opening is generally ovate and extends centrally across said top wall.

6. A carrying handle according to claim 2, further comprising a second handle panel defined by a second handle fold line extending across said top wall, said second handle panel having a free edge defined by said peripheral edge of said opening and by said slit means.

* * * * *